US011877669B1

(12) United States Patent
Marks

(10) Patent No.: US 11,877,669 B1
(45) Date of Patent: Jan. 23, 2024

(54) COUCH COOLER WITH STABILIZING FIN

(71) Applicant: Eric Marks, Vancouver, WA (US)

(72) Inventor: Eric Marks, Vancouver, WA (US)

( * ) Notice: Subject to any disclaimer, the term of this patent is extended or adjusted under 35 U.S.C. 154(b) by 0 days.

(21) Appl. No.: 18/461,139

(22) Filed: Sep. 5, 2023

Related U.S. Application Data

(60) Provisional application No. 63/404,146, filed on Sep. 6, 2022.

(51) Int. Cl.

| | |
|---|---|
| ***A47C 7/62*** | (2006.01) |
| ***A47C 7/72*** | (2006.01) |
| ***A47C 7/54*** | (2006.01) |
| ***A47C 17/02*** | (2006.01) |

(52) U.S. Cl.
CPC ..... *A47C 7/622* (2018.08); *A47C 17/02* (2013.01)

(58) Field of Classification Search
CPC ..... A47C 7/624; A47C 7/62; A47C 7/622
See application file for complete search history.

(56) References Cited

U.S. PATENT DOCUMENTS

| | | | | |
|---|---|---|---|---|
| 9,295,348 | B2 | 3/2016 | Johnson | |
| 10,161,564 | B1 | 12/2018 | Delobel | |
| D985,299 | S * | 5/2023 | Collier | D6/716.2 |
| 11,751,692 | B2 * | 9/2023 | Zhao | A47C 7/541 297/411.23 |
| 2013/0270417 | A1 * | 10/2013 | Pemberton | F16M 13/00 248/682 |
| 2022/0022656 | A1 * | 1/2022 | Zhao | A47C 7/546 |

OTHER PUBLICATIONS

Recpro Charles Collection, RV Furniture Portable Cup Holders in Cloth, https://www.recpro.com/rv-furniture-portable-cup-holders-in- cloth/?gclid=CjwKCAjw_JuGBhBkEiwA1xmbRez3Xew116LI0QzcVthA29tD3o ale9Dv-CzmsW4_vwv4n67NoWWQnBoCHx0QAvD_BwE, last visited: Jun. 14, 2021.

Storage Element with Cooling Cup Holdre and Wireless Phone Charger, https://www.sofadreams.com/storage-element-with-cooling-cupholder-and-wireless-phone- charger.html, last visited: Jun. 14, 2021.

* cited by examiner

*Primary Examiner* — Shin H Kim
(74) *Attorney, Agent, or Firm* — Trojan Law Offices

(57) ABSTRACT

A stabilizing fin for coupling a cooler to a furniture having two walls, comprising a body having at least two flaps, the flaps having proximal ends and distal ends. The proximal ends of the at least two flaps can be hingedly coupled to each other through a hinged connector. The body may include an attachment mechanism to couple the body to the cooler. The at least two flaps can be folded toward each other over the hinged connector to form a flat fin, wherein the formed flat fin can be inserted frictionally between the two walls of the furniture through the distal ends of the at least two flaps, and wherein a biasing mechanism causes at least one flap of the at least two flaps to exert force against at least one wall of the two walls of the furniture, thereby holding the body and the attached cooler in place.

20 Claims, 4 Drawing Sheets

COUCH COOLER WITH STABILIZING FIN

CROSS-REFERENCE TO RELATED APPLICATIONS

This application claims the priority filing date of the U.S. Provisional Patent Application No. 63/404,146 filed on Sep. 6, 2022, the contents of which is incorporated herein by reference in its entirety.

TECHNICAL FIELD

The present invention relates to accessories for chairs such as holders and receptacles, and more particularly, to structural supports for providing stability to a cooler, container, or bag when placed on a furniture such as a couch/sofa or when being transported.

BACKGROUND

Existing seating arrangements such as couches and vehicular seats typically lack convenient means for stowing easily accessible beverages, bags, and coolers. Seating arrangements with such features are expensive and heavy due to additional materials required. These so-modified seating arrangements are financially prohibitive and physically unwieldy for most consumers. Furthermore, seating arrangements that do possess these features typically lack the ability to conveniently stow such structures when not in use, thereby making such seating arrangements less comfortable to users. Therefore, a need exists to provide consumers with convenient means for storing objects and to provide portable containers allowing access to the same.

SUMMARY

The purpose of this invention is to provide structural support and stability to a cooler, container, or bag when in use on a furniture such as a couch/sofa/vehicular seat or when being transported. The device offers compatibility to various coolers, bags, and couches. While in "transport mode," the invention allows the cooler to maintain shape and hold the contents more uniformly. In "couch mode," the invention provides temporary attachment to the couch to prevent the cooler from tipping over. This is particularly important if the cooler/bag has cupholders that might contain an open beverage. The device is also able to act as a divider internal to a cooler or bag and be easily removed for cleaning and storage.

The present invention discloses a stabilizing fin for coupling a cooler to a furniture having two walls, comprising a body having at least two flaps, the at least two flaps having proximal ends and distal ends. The proximal ends of the at least two flaps can be hingedly coupled to each other through a hinged connector. The body may include an attachment mechanism to couple the body to the cooler. The at least two flaps can be folded toward each other over the hinged connector to form a flat fin, wherein the formed flat fin can be inserted frictionally between the two walls of the furniture through the distal ends of the at least two flaps, and wherein a biasing mechanism causes at least one flap of the at least two flaps to exert force against at least one wall of the two walls of the furniture, thereby holding the body and the attached cooler in place.

The biasing mechanism may comprise two cords. The proximal ends of the at least two flaps can be coupled to each other by the two cords, wherein the two cords are adapted to be attached to the cooler box, and wherein when the at least two flaps are folded to form the flat fin, the two cords can pull the at least two flaps, thereby exerting force against the two walls of the furniture. The two cords can be adapted to hook on two hooks located on the cooler. The two cords can be elastic cords. In various implementation of the invention, the biasing mechanism can also comprise a spring loaded mechanism, a wire, two or more wires, and/or at least two wires with single point hinges.

The attachment mechanism that couples the body to the cooler may comprise a hook and loop mechanism, a slide bar adapted to be attached to a channel positioned on the cooler, a snap button mechanism, and/or a magnetic mechanism.

The present invention also discloses a method of coupling a cooler to a furniture having two walls through a stabilizing fin, comprising the steps of providing a body having at least two flaps, the at least two flaps having proximal ends and distal ends; coupling the proximal ends of the at least two flaps hingedly to each other through a hinged connector; folding the at least two flaps toward each other over the hinged connector to form a flat fin; inserting the formed flat fin frictionally between the two walls of the furniture through the distal ends of the at least two flaps; coupling the body to the cooler through an attachment mechanism; and biasing at least one flap of the at least two flaps by a biasing mechanism to exert force against at least one wall of the two walls of the furniture, whereby holding the body and the attached cooler in place.

The method can further comprise the steps of coupling the proximal ends of the at least two flaps to each other by two cords; providing the attachment mechanism by attaching the two cords to the cooler box, wherein when the at least two flaps are folded to form the flat fin, the two cords pull the at least two flaps, thereby exerting force against the two walls of the furniture. The two cords can be adapted to hook on two hooks located on the cooler. The two cords can be elastic cords.

In the method of coupling a cooler to a furniture having two walls through a stabilizing fin, the biasing mechanism may comprise a spring loaded mechanism, a wire, two or more wires, and/or at least two wires with single point hinges.

In various implementations of the method of coupling a cooler to a furniture having two walls through a stabilizing fin, the attachment mechanism that couples the body to the cooler may comprise a hook and loop mechanism, a slide bar adapted to be attached to a channel positioned on the cooler, a snap button mechanism, and/or a magnetic mechanism.

BRIEF DESCRIPTION OF THE DRAWINGS

These and other features and advantages of the present invention will become appreciated, as the same becomes better understood with reference to the specification, claims and drawings herein:

DETAILED DESCRIPTION

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and to fully convey the scope of the invention to those skilled in the art.

Figure 1:
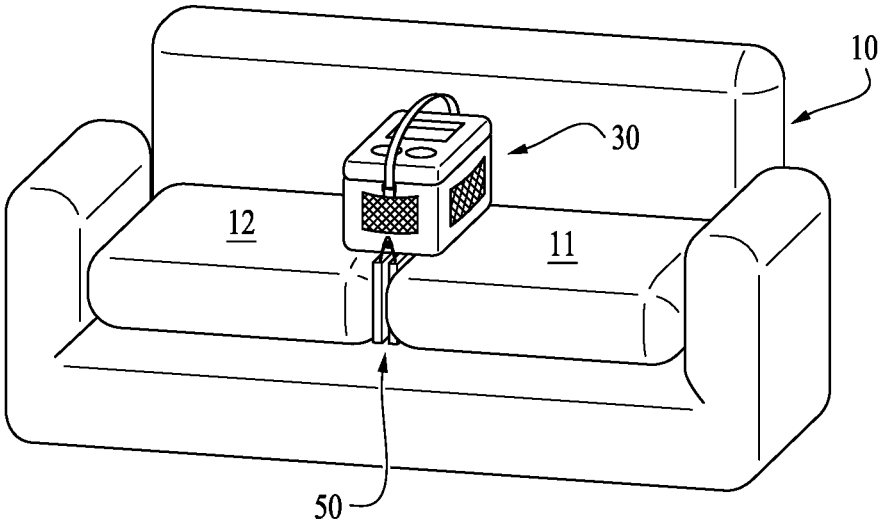
FIG. 1 shows a perspective view of a cooler and stabilizing fin coupled to a representative furniture.

An embodiment of the present invention provides a cooler with a stabilizing fin. The cooler can be attached to the stabilizing fin through an attachment mechanism. The stabilizing fin comprises two flaps that can be folded over a hinged connector toward each other to form a flat fin, wherein the formed flat fin can be inserted frictionally between the two walls of a furniture, such as between two cushions of a couch as illustrated in FIG. 1. Accordingly, the cooler will be held in place on the furniture through the stabilizing fin. Two flaps provide stability though their shape and size. For example, the two flaps can be rectangular boards of equal size that are hingedly connected via the hinged connector along the longer side of the boards. The two flaps can also take other shapes of equal size or shapes with different sizes. According to an implementation of the present invention, the two flaps can be the approximate size of the cooler base or optionally a bag they are designed therefore. This can allow the two flaps of the stabilizing fin to fill out and hold the shape of the cooler when it is in use on the go. According to an implementation of the invention, the two flaps may be comprised of a rigid material such as plastic and optionally wrapped in a more abrasive, friction promoting nylon-like cloth material. This will help with durability and general friction when attached to a furniture such as a couch as shown in FIGS. 1-3.

Figure 2:
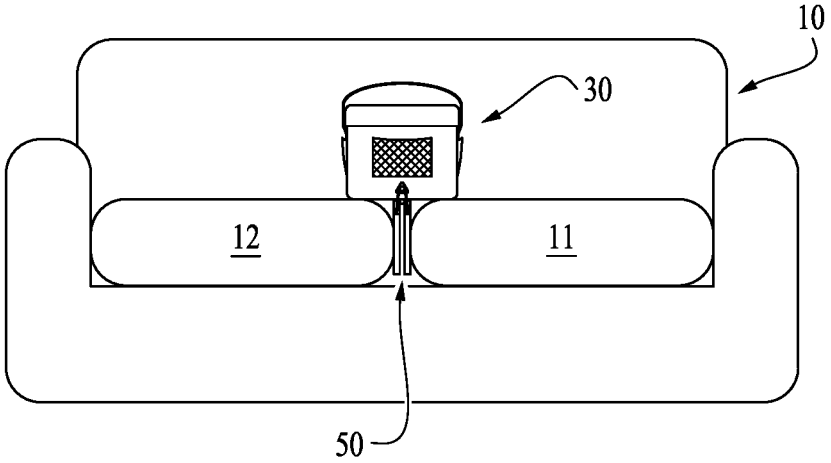
FIG. 2 shows a front view of a cooler and stabilizing fin coupled to a representative furniture.

The hinged connector allows the transition between different modes of use, "couch mode" and "transport mode." In the "couch mode," the stabilizing fin is in a folded position as shown in FIGS. 1-2. In the "transport mode," the stabilizing fin can be positioned within a compartment of a cooler or bag where the stabilizing fin is unfolded with the two flaps open or optionally folded. The two flaps are coupled to each other through the hinged connector that can be preferably comprised of cloth stitched in a durable and thick manner to avoid damage over time. In other embodiments, the hinged connector may be comprised of metal or plastic.

In various implementations of this invention, the stabilizing fin can operate as an attachment means for both the inside and outside of a soft bag, cooler, or container. This attachment is to be used on the bottom of the cooler and on the inside of the cooler depending on what the user needs at any given time. As a non-limiting example, to operate the invention, the user will initially remove the stabilizing fin out of the interior of the cooler, fold the two flaps of the stabilizing fin, insert the stabilizing fin in a folded position between two couch cushions, and attach the stabilizing fin to the cooler with the attachment mechanism as shown in FIG. 1.

Figure 3:
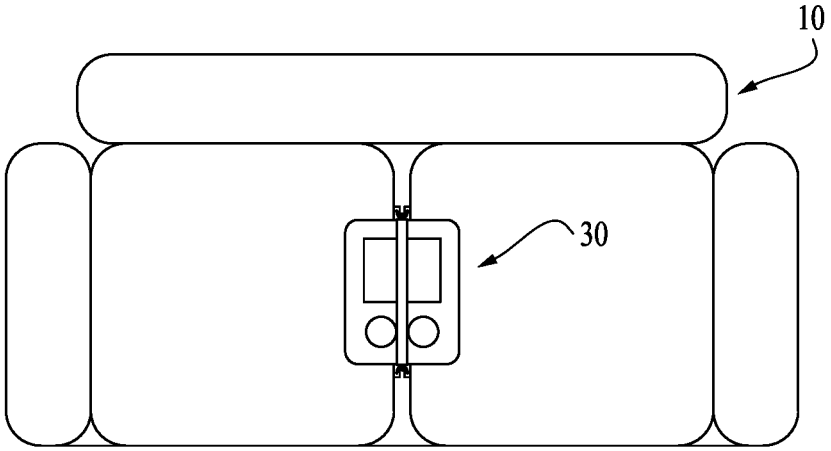
FIG. 3 shows a top view of a cooler and stabilizing fin coupled to a representative furniture.

FIGS. 1-3 illustrate an exemplary embodiment of the invention wherein the cooler 30 is attached to a couch 10 through a stabilizing fin 50, wherein the stabilizing fin, in its folded position, is being placed between two cushions (11, 12) of the couch 10, thereby holding the attached cooler in place.

Figure 4:
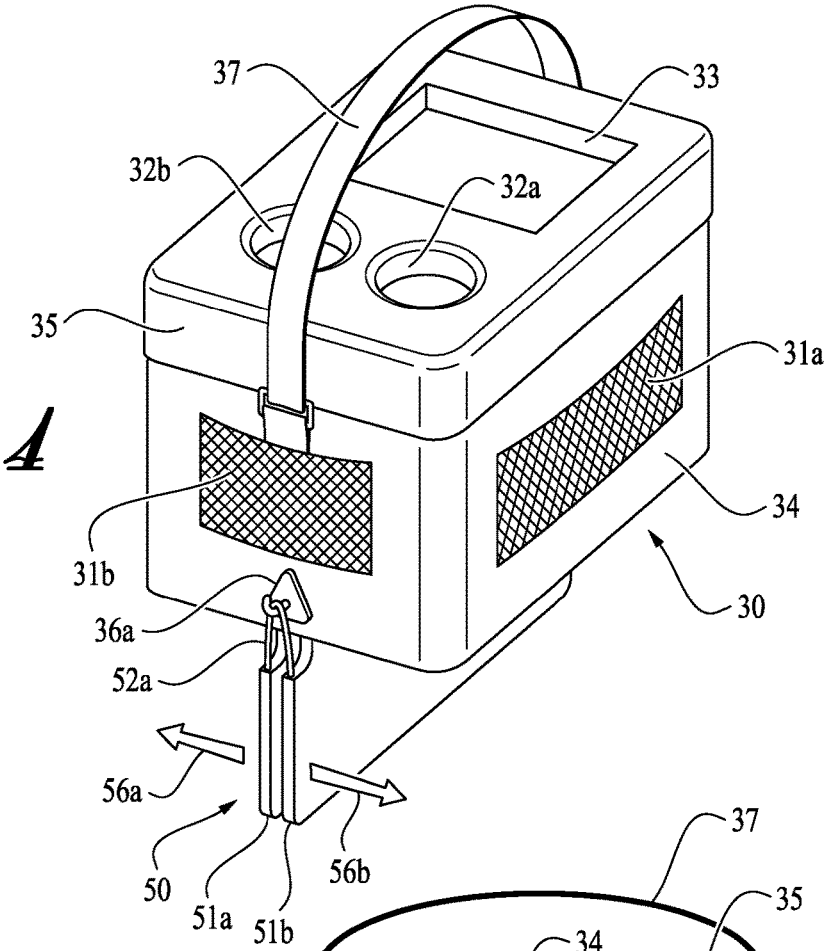
FIG. 4. shows a perspective view of a cooler and stabilizing fin that is hooked to the hooks located on the cooler through cords.

According to FIG. 4, the cooler may comprise a cooler body 34 and a top cover 35. The top cover 35 may comprise cupholders (32*a*, 32*b*) and other compartments such a top compartment 33. The cooler may further comprise storage pockets (such as 31*a*, 31*b*) on the sides. In "transport mode," a handle or a shoulder strap 37 can be used to carry the cooler and the attached fin.

Figure 5:
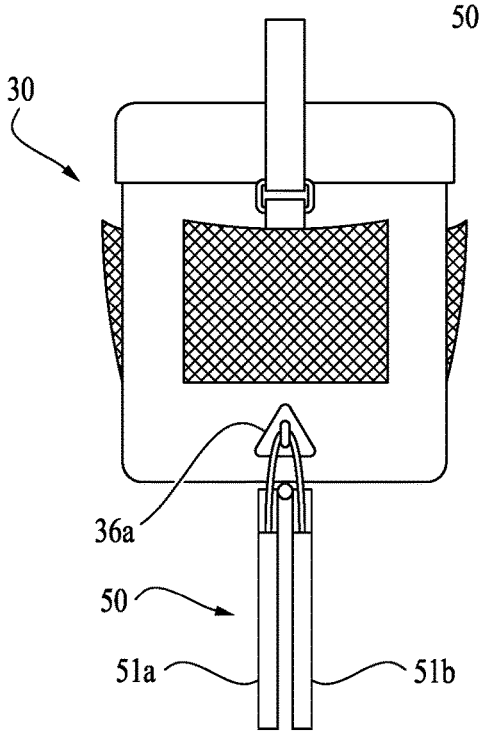
FIG. 5. shows a front view of a cooler and stabilizing fin that is hooked to the hooks located on the cooler through cords.
Figure 6:
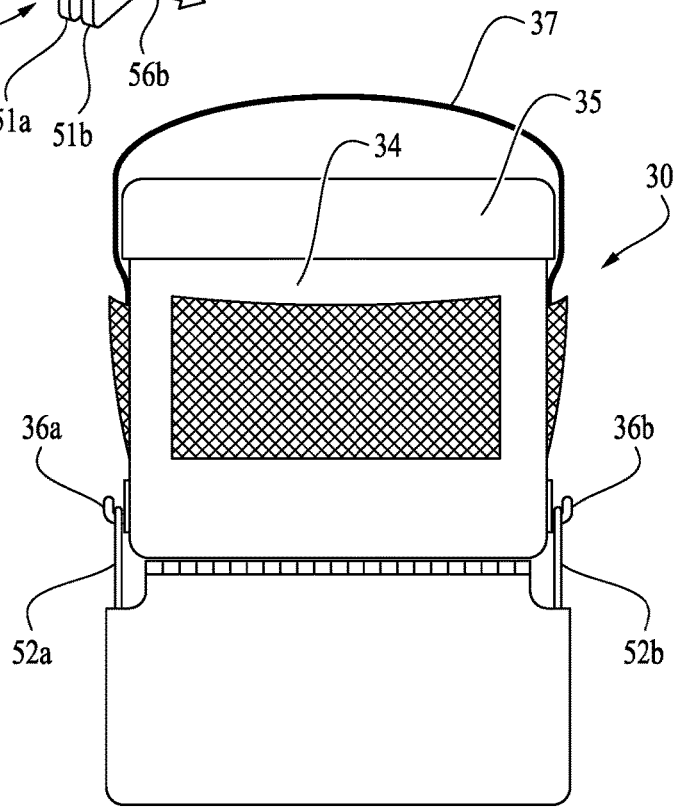
FIG. 6. shows a side view of a cooler and stabilizing fin that is hooked to the hooks located on the cooler through cords.

According to FIGS. 4-6, the cooler 30 is attached to the stabilizing fin 50 through cords (52*a* as shown in FIGS. 4-6 and 52*b* as shown in FIG. 6). In FIGS. 4-6, the stabilizing fin is shown in its fully folded position wherein its two flaps (51*a*, 51*b*) are completely folded toward each other. When the stabilizing fin is in its folded position, it can be frictionally inserted between two cushions of a couch as shown in FIG. 1. According to an implementation of this embodiment, when the stabilizing fin 50 is inserted between two cushions as shown in FIG. 1, the two flaps (51*a*, 51*b*) of the stabilizing fin 50 are biased to exert force (as shown with the force vectors 56*a* and 56*b*) against the adjacent walls of the cushions (11, 12 as shown in FIG. 1). This mechanism creates a lateral force (see also force vectors 56*a*, 56*b* in FIG. 4) against the cushions themselves and doesn't solely rely on the friction of materials or tightness of the cushions to keep the attached cooler 30 resting on top in place.

Figure 9:
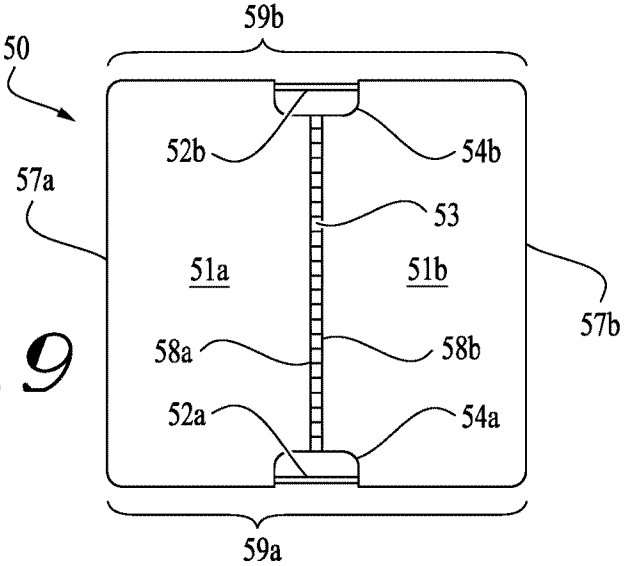
FIG. 9. shows a top view of the stabilizing fin having cords in its unfolded position.
Figure 12:
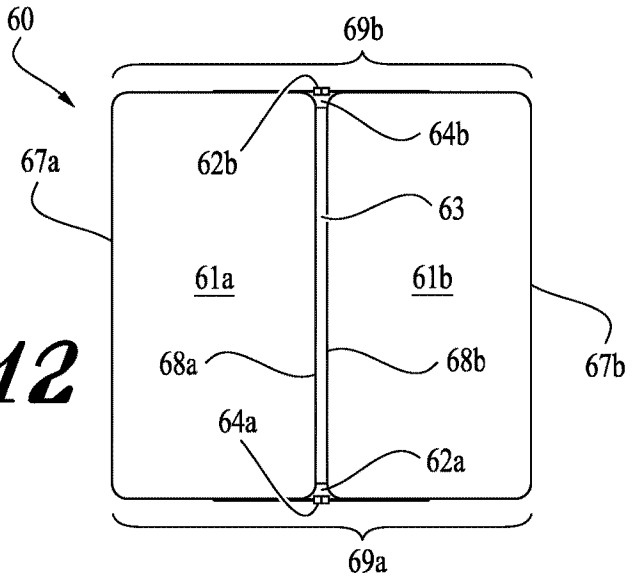
FIG. 12. shows a top view of the stabilizing fin having wire cords in its unfolded position.

In "transport mode," when the stabilizing fin 50 is attached to the cooler 30 and is in its fully unfolded/expanded position (as shown in FIGS. 9 and 12), the invention allows the cooler to maintain shape and hold the contents more uniformly. In "couch mode," the invention provides temporary attachment to the couch to prevent the cooler from tipping over. This is particularly important if the cooler/bag has cupholders that might contain an open beverage. The stabilizing fin is also able to act as a divider internal to a cooler or bag and be easily removed for cleaning and storage.

Figure 8:
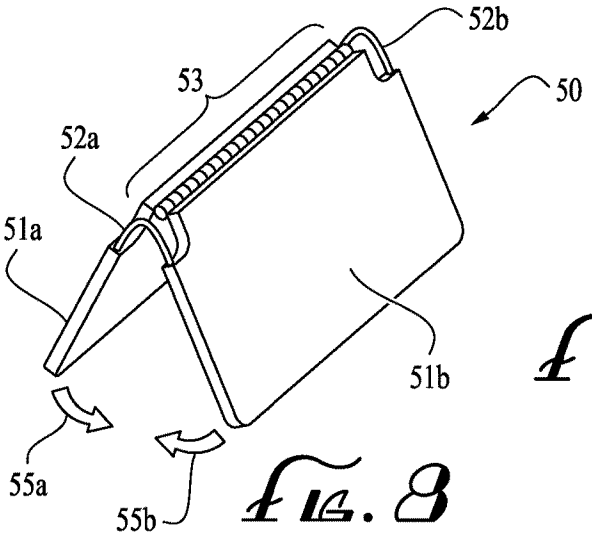
FIG. 8. shows a perspective view of the stabilizing fin having cords in its semi-folded position.
Figure 7:
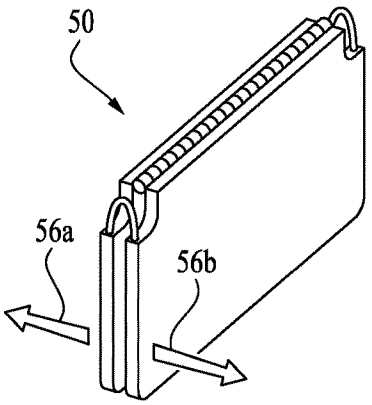
FIG. 7. shows a perspective view of the stabilizing fin having cords in its completely folded position.

FIGS. 7-9 illustrate an implementation of a stabilizing fin according to the present invention. According to FIG. 9, the stabilizing fin 50 may comprise two flaps (51*a*, 51*b*) having proximal ends (58*a*, 58*b*) and distal ends (57*a*, 57*b*), wherein the two flaps are connected to each other on their proximal ends (58*a*, 58*b*) through a hinged connector 53. This allows the two flaps to behave like the wings of a butterfly. The fin 50 further comprises cords (52*a*, 52*b*) that are connected to the front sides 59*a* and back sides 59*b* of the two flaps (51*a*, 51*b*). As a non-limiting example, the hinged connector 53 can be a hinge or flexible material along the proximal ends of the two flaps. As a non-limiting example, the hinged connector can comprise a metal hinge such as a full length piano hinge or multiple smaller hinges, or a plastic living hinge such as an extruded plastic with thin hinge flex, a traditional but hinge, or a spring loaded hinge. The fin 50 can be further coupled to the cooler 30 (as shown in FIGS. 4-6) by further attachment mechanisms such as the ones shown in FIGS. 13-19.

According to FIG. 9, in "transport mode," the two flaps (51*a*, 51*b*) are in expanded/unfolded position, and the fin 50 is attached to a cooler. As illustrated in FIGS. 7-8, in the "couch mode," the two flaps are folded over the hinged connector 53 in the direction shown by arrows 55*a* and 55*b* to form a flat fin as shown in FIG. 7 allowing the two flaps (51*a*, 51*b*) to be frictionally inserted through their distal ends (57*a*, 57*b*) between two walls of two cushions (as further shown in FIG. 1).

According to an implementation of this embodiment, the cords 52*a* and 52*b* (as shown in FIGS. 7-9) can be elastic cords, such as elastic bungee cables, that can be temporarily hooked on hooks (36*a*, 36*b*) located on a cooler as shown in FIGS. 4-6. As shown in FIG. 9, U-shaped cutouts (54*a*, 54*b*) can be created on the front sides 59*a* and back sides 59*b* of the two flaps (51*a*, 51*b*) to leave spaces for the elastic cords to connect the two flaps to each other. The elastic cords (52*a*, 52*b*) are not under tension in either folded "couch mode" or unfolded "transport mode." The elastic cords are only in tension when attached and stretched up to hook on the hooks positioned on the cooler body when the two flaps are folded, thereby pulling the cooler down towards the couch. In other words, when the two flaps (51*a*, 51*b*) are in their folded position and the elastic cords (52*a*, 52*b*) are being stretched and attached to the hooks on the cooler body, the elastic cords simultaneously pull the cooler downwardly towards the couch and pull the two flaps upwardly towards the cooler to create force (56*a* and 56*b* in FIG. 7) against the two walls of a furniture such as two walls of two cushions of a couch as illustrated in FIG. 1. This force creates friction that prevents the two folded flaps (51*a*, 51*b*) from sliding out while being inserted between the two walls of a furniture.

In this configuration, tension pulls the two flaps upwardly as if to open into a flat orientation. The flat orientation is impossible because the two walls (of the cushions) serve as an opposing force. The two walls of the cushions are holding the two flaps with friction thus, the secured stabilizing fin stays in place and resists movement. Likewise, since the two flaps aren't able to move up further, the elastic cords pull the cooler close and tight against a representative couch cushion top as shown in FIG. 1. When the invention is in "couch mode" and the stabilizing is folded in between the cushions, the elastic cords are pulling the cooler down and holding it securely to the couch. As shown in FIG. 1, if the elastic cords are stretched, they would naturally try to flatten out the two flaps of the stabilizing fin to an open mode since the elastic cords are connected off center. This force principle provides additional friction outwards toward the cushions as shown by the horizontal arrows 56*a* and 56*b* in FIG. 7.

In this embodiment, the elastic cords can also serve as an attachment mechanism when the stabilizing fin is used in "couch mode," and when the stabilizing fin is used in "transport mode."

This embodiments of the present invention demonstrates ease of use and lower cost to manufacture. The invention is easy to use for several reasons. Firstly, the fold along the hinged connector can be reversable. So, a user can easily fold the stabilizing fin in half and insert it between the couch cushions without thinking which way is the correct way to fold it. Secondly, the primary way to attach the stabilizing fin to the cooler or bag body is to simply hook the elastic cords to the sides. This is opposed to having to line up or align the cooler to attach it. Lastly, the stabilizing fin is easy to use because it can quickly be pulled out from between a set of couch cushions and inserted into a cooler or bag body to take hydration on the go. The materials comprising the device are inexpensive to manufacture as the main components all use common materials such as nylon cloth, available plastic parts (cupholder rings for example), and elastic bungee cables. Compatibility between different coolers or bags is also an advantage with this invention because it supports future product line development and offers value to existing customers to purchase other types of compatible products.

Figure 11:
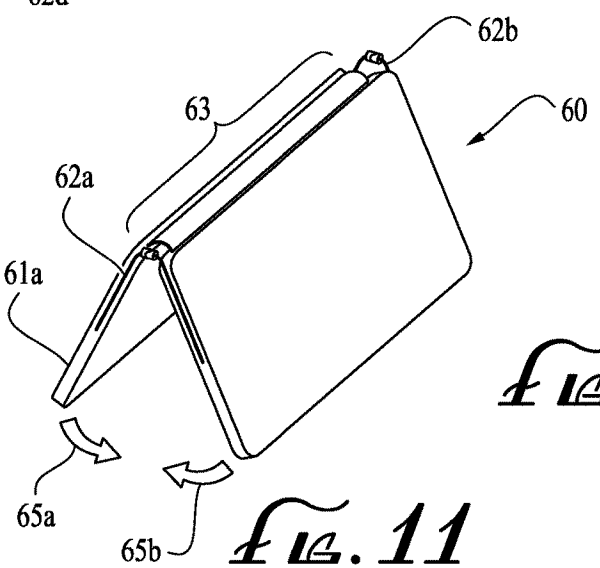
FIG. 11. shows a perspective view of the stabilizing fin having wire cords in its semi-folded position.
Figure 10:
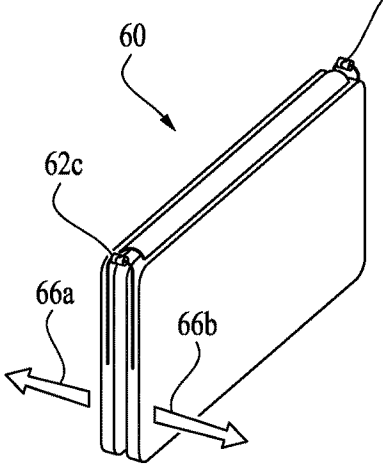
FIG. 10. shows a perspective view of the stabilizing fin having wire cords in its completely folded position.
Figure 14:
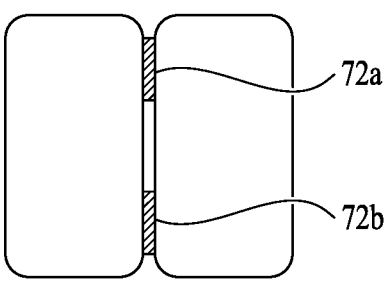
FIG. 14. shows a top view of the stabilizing fin with a magnetic attachment mechanism.

FIGS. 10-12 illustrate another implementation of a stabilizing fin according to the present invention. According to FIG. 12, the stabilizing fin 60 may comprise two flaps (61*a*, 61*b*) having proximal ends (68*a*, 68*b*) and distal ends (67*a*, 67*b*), wherein the two flaps are connected to each other on their proximal ends (68*a*, 68*b*) through a hinged connector 63. This allows the two flaps to behave like the wings of a butterfly as they are hingedly connected along their proximal ends. The fin 60 further comprises wires (62*a*, 62*b*) that are connected to the front sides 69*a* and back sides 69*b* of the two flaps (61*a*, 61*b*). As a non-limiting example, the hinged connector 63 can be a hinge or flexible material along the proximal ends of the two flaps. According to an implementation of this embodiment, internal wires (62*a*, 62*b*) or wires (62*a*, 62*b*) with single point hinges (62*c*, 62*d*) are deployed at the front sides 59*a* and back sides 59*b* of the two flaps (51*a*, 51*b*) as shown in FIGS. 10-12. These figures showcase alternative embodiments creating the hinge motion underlying the foldable stabilizing fin. The fin 60 can be coupled temporarily to a cooler by an attachment mechanism, such as the ones shown in FIGS. 13-19.

According to FIG. 12, in "transport mode," the two flaps (61*a*, 61*b*) are in expanded/unfolded position, and the fin 60 is attached to a cooler. As illustrated in FIGS. 10-12, in the "couch mode," the two flaps are folded over the hinged connector 63 in the direction shown by arrows 65*a* and 65*b* to form a flat fin as shown in FIGS. 10-11 allowing the two flaps (61*a*, 61*b*) to be frictionally inserted through their distal ends (67*a*, 67*b*) between two walls of two cushions (as shown in FIG. 1).

The wires 62*a* and 62*b* as shown in FIGS. 10-12 can be flexible metal wires that allow bending and hold shape. Wires can also act as wire frame around the exterior of the two flaps. When the two flaps (61*a*, 61*b*) are in their folded position, the flexible wires simultaneously pull the two flaps upwardly towards the cooler to create force (66*a* and 66*b* in FIG. 10) against the two walls of a furniture such as two walls of two cushions of a couch as illustrated in FIG. 1. This force creates friction that prevents the two folded flaps (61*a*, 61*b*) from sliding out while being inserted between the two walls of a furniture.

Figure 13:
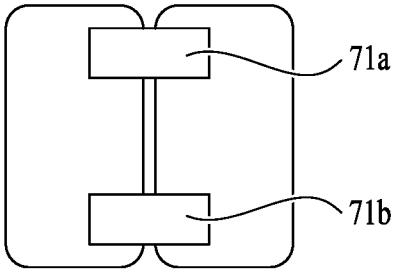
FIG. 13. shows a top view of the stabilizing fin with a hook and loop attachment mechanism.
Figure 15:
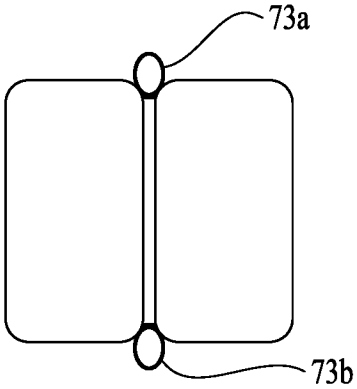
FIG. 15. shows a top view of the stabilizing fin with elastic loops attachment mechanism.
Figure 19:
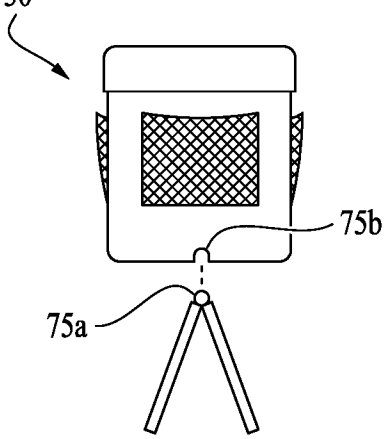
FIG. 19. shows a front view of the stabilizing fin and the cooler with a rod and channel attachment mechanism.
Figure 18:
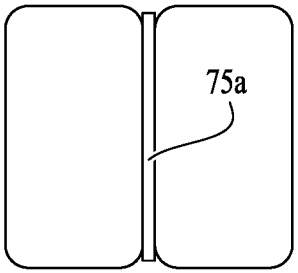
FIG. 18. shows a top view of the stabilizing fin with a rod attachment mechanism.
Figure 17:
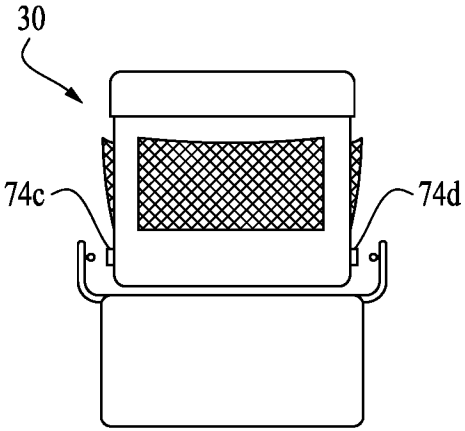
FIG. 17. shows a side view of the stabilizing fin and the cooler with a snap button attachment mechanism.
Figure 16:
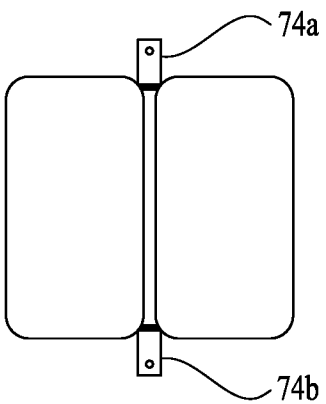
FIG. 16. shows a top view of the stabilizing fin with a snap button attachment mechanism.

As shown in in FIGS. 13-19, various embodiments of the present invention utilize various attachment mechanisms for coupling the stabilizing fin to the cooler. As non-limiting examples, these include (1) stretch Velcro straps or a hook and loop mechanism that can be positioned on the stabilizing fin (as shown in FIG. 13) and on the corresponding positions on the cooler (not shown), (2) magnets (72*a* and 72*b* in FIG. 14) that can be coupled to corresponding magnetic materials on the cooler (not shown), and (3) variable elastic loops (73*a* and 73*b* in FIG. 15) that can be coupled to corresponding points on the cooler such as hooks (not shown). According to FIGS. 16-17, the attachment mechanism can be buttons/snaps. For example, this attachment mechanism may comprise two straps (74*a* and 74*b* as shown in FIG. 16) extending from the proximal ends of the two flaps of the stabilizing fin, wherein button/snaps at the end of the straps are coupled to the cooler as shown in FIG. 17. According to FIGS. 18-19, the attachment mechanism can also be a rod 75*a* that slides into a channel positioned at the bottom of the cooler 30, wherein the bottom of the cooler comprises a channel 75*b* that the rod 75*a* fits into. In the alternative, the rod 20 can snap into the channel at the bottom of the cooler. A preferred embodiment utilizes bungee cables (73*a* and 73*b* in FIG. 15) which provide an optimally secure hold at a reasonable manufacturing cost.

While the above description refers to a couch as a representative apparatus with which the stabilizing fin is compatible, the inventive device is not limited to such use and is expressly designed for use across various types of furniture and sitting apparatuses.

What is claimed is:

1. A stabilizing fin for coupling a cooler to a furniture having two walls, comprising:

a body having at least two flaps;

the at least two flaps having proximal ends and distal ends;

the proximal ends of the at least two flaps are hingedly coupled to each other through a hinged connector;

the body includes an attachment mechanism to couple the body to the cooler;

wherein the at least two flaps can be folded toward each other over the hinged connector to form a flat fin;

wherein the formed flat fin can be inserted frictionally between the two walls of the furniture through the distal ends of the at least two flaps; and wherein a biasing mechanism causes at least one flap of the at least two flaps to exert force against at least one wall of the two walls of the furniture, thereby holding the body and the attached cooler in place.

2. The stabilizing fin of claim 1 wherein the biasing mechanism comprises two cords;

the proximal ends of the at least two flaps are coupled to each other by the two cords;

wherein the two cords are adapted to be attached to the cooler box;

wherein when the at least two flaps are folded to form the flat fin, the two cords pull the at least two flaps, thereby exerting force against the two walls of the furniture.

3. The stabilizing fin of claim 2 wherein the two cords are adapted to hook on two hooks located on the cooler.

4. The stabilizing fin of claim 3 wherein the two cords are elastic cords.

5. The stabilizing fin of claim 1 wherein the biasing mechanism comprises a spring loaded mechanism.

6. The stabilizing fin of claim 1 wherein the biasing mechanism comprises at least two wires.

7. The stabilizing fin of claim 1 wherein the biasing mechanism comprises at least two wires with single point hinges.

8. The stabilizing fin of claim 1 wherein the attachment mechanism that couples the body to the cooler comprises a hook and loop mechanism.

9. The stabilizing fin of claim 1 wherein the attachment mechanism that couples the body to the cooler comprises a slide bar adapted to be attached to a channel positioned on the cooler.

10. The stabilizing fin of claim 1 wherein the attachment mechanism that couples the body to the cooler comprises a magnetic mechanism.

11. A method of coupling a cooler to a furniture having two walls through a stabilizing fin, comprising the steps of:

providing a body having at least two flaps, the at least two flaps having proximal ends and distal ends;

coupling the proximal ends of the at least two flaps hingedly to each other through a hinged connector;

folding the at least two flaps toward each other over the hinged connector to form a flat fin;

inserting the formed flat fin frictionally between the two walls of the furniture through the distal ends of the at least two flaps;

coupling the body to the cooler through an attachment mechanism; and biasing at least one flap of the at least two flaps by a biasing mechanism to exert force against at least one wall of the two walls of the furniture, whereby holding the body and the attached cooler in place.

12. The method of claim 11, further comprising the steps of:

coupling the proximal ends of the at least two flaps to each other by two cords;

providing the attachment mechanism by attaching the two cords to the cooler box;

wherein when the at least two flaps are folded to form the flat fin, the two cords pull the at least two flaps, thereby exerting force against the two walls of the furniture.

13. The method of claim 12 wherein the two cords are adapted to hook on two hooks located on the cooler.

14. The method of claim 13 wherein the two cords are elastic cords.

15. The method of claim 11 wherein the biasing mechanism comprises a spring loaded mechanism.

16. The method of claim 11 wherein the biasing mechanism comprises at least two wires.

17. The method of claim 11 wherein the biasing mechanism comprises at least two wires with single point hinges.

18. The method of claim 11 wherein the attachment mechanism that couples the body to the cooler comprises a hook and loop mechanism.

19. The method of claim 11 wherein the attachment mechanism that couples the body to the cooler comprises a slide bar adapted to be attached to a channel positioned on the cooler.

20. The method of claim 11 wherein the attachment mechanism that couples the body to the cooler comprises a magnetic mechanism.

* * * * *